United States Patent [19]

Kiriake

[11] Patent Number: 4,597,540

[45] Date of Patent: Jul. 1, 1986

[54] BOBBIN SUPPLYING DEVICE IN AUTOMATIC WINDER

[75] Inventor: Masaharu Kiriake, Kyoto, Japan

[73] Assignee: Murata Kikai Kabushiki Kaisha, Japan

[21] Appl. No.: 538,664

[22] Filed: Oct. 3, 1983

[30] Foreign Application Priority Data

Oct. 13, 1982 [JP] Japan ..... 57-180466

[51] Int. Cl.[4] ..... B65H 54/20; B65H 67/06

[52] U.S. Cl. ..... 242/35.5 A; 242/35.5 R

[58] Field of Search ..... 242/35.5 A, 35.5 R, 242/35.6 R, 35.6 E

[56] References Cited

U.S. PATENT DOCUMENTS 3,217,235 11/1965 Kieronski ..... 242/35.5 A
3,358,940 12/1967 Beckwith, Jr. et al. ..... 242/35.5 A
3,399,840 9/1968 Hayashi et al. ..... 242/35.5 R
3,480,128 11/1969 Brouwer et al. ..... 242/35.5 R X
3,850,377 11/1974 Pitts et al. ..... 242/35.5 A X
3,933,320 1/1976 Tsurumi et al. ..... 242/35.5 R
4,212,433 7/1980 Matsui et al. ..... 242/35.5 A

FOREIGN PATENT DOCUMENTS 141362 9/1982 Japan ..... 242/35.5 A

*Primary Examiner*—Stanley N. Gilreath
*Attorney, Agent, or Firm*—Spensley Horn Jubas & Lubitz

[57] ABSTRACT

A full bobbin supply and an empty bobbin ejecting device for an automatic winder disposed between a full bobbin feeding conveyor and an empty bobbin ejecting conveyor. A full bobbin doffed from a spinning frame is fitted on a peg erected on a bobbin carrier and conveyed. The bobbin carrier with the bobbin is stopped at the stand-by position by a first stopper, and then supplied to a yarn running position of the winding unit.

9 Claims, 4 Drawing Figures

BOBBIN SUPPLYING DEVICE IN AUTOMATIC WINDER

BACKGROUND OF THE INVENTION

The present invention relates to a bobbin supplying device for an automatic winder.

Generally, full bobbins wound on a fine spinning frame are doffed as a group from spindles of the fine spinning frame, stored temporarily in a storage location, and then the required number of bobbins are supplied to a winder.

The applicant of the present invention proposed a device, such as proposed in Japanese Patent Laid-open No. 141362/82, for supplying bobbins surely to winders by simple means without damaging the surface yarn layers of those bobbins, in which a bobbin is erected on a peg fixed to a disk-shaped bobbin carrier, the bobbin carrier with a bobbin is conveyed by a conveyor and is transferred onto a rotary disk, and then the bobbin carrier with a bobbin is placed at a yarn running position of a winding unit by the rotary disk. The above bobbin supplying device achieved the intended objects successfully. However, an additional function was required of the above bobbin supplying device, to introduce the yarn end of a full bobbin placed at the yarn running position more surely into the suction pipe of the winding unit. According to the conventional system, the yarn end is blown upward by air and is sucked into and held by the suction pipe disposed in place. However, in such a conventional constitution, it was difficult to dispose the nozzle for blowing the yarn end upward at a proper position due to the existence of other members, and hence it was impossible to blow upward the yarn end properly and surely. This problem, namely, securing an appropriate position for disposing the nozzle, needs to be solved simultaneously with a problem of securing an appropriate yarn running position for the bobbin carrier, namely, placing a carrier with a full bobbin surely at the yarn running position in replacing a carrier having an empty bobbin, with a carrier having a full bobbin.

SUMMARY OF THE INVENTION

An object of the present invention is to provide a device in which the transfer of a bobbin from a stand-by position to a yarn running position of the winding unit is carried out surely and quickly and the yarn end of the bobbin is blown upward surely at the yarn running position.

According to the present invention, a bobbin carrier with a full bobbin is conveyed by the bobbin feeding conveyor to a rotary disk and is transferred onto the rotary disk. The bobbin carrier with a full bobbin transferred onto the rotary disk is stopped at the stand-by position by means of a first stopper and then is moved to the yarn running position to be retained by a second stopper. Through holes are formed in the bobbin carrier and the rotary disk respectively to introduce the air jetted by the nozzle into the bore of the bobbin tube.

Thus, an air jet nozzle can be disposed directly below the center of the yarn running position without interfering with transferring the carrier to the yarn running position, and thereby the yarn end of the bobbin mounted on the carrier is blown upward surely and is delivered to the winding unit.

DETAILED DESCRIPTION OF THE INVENTION

A preferred embodiment of the present invention will be described hereinafter in connection with accompanying drawings.

Figure 1:
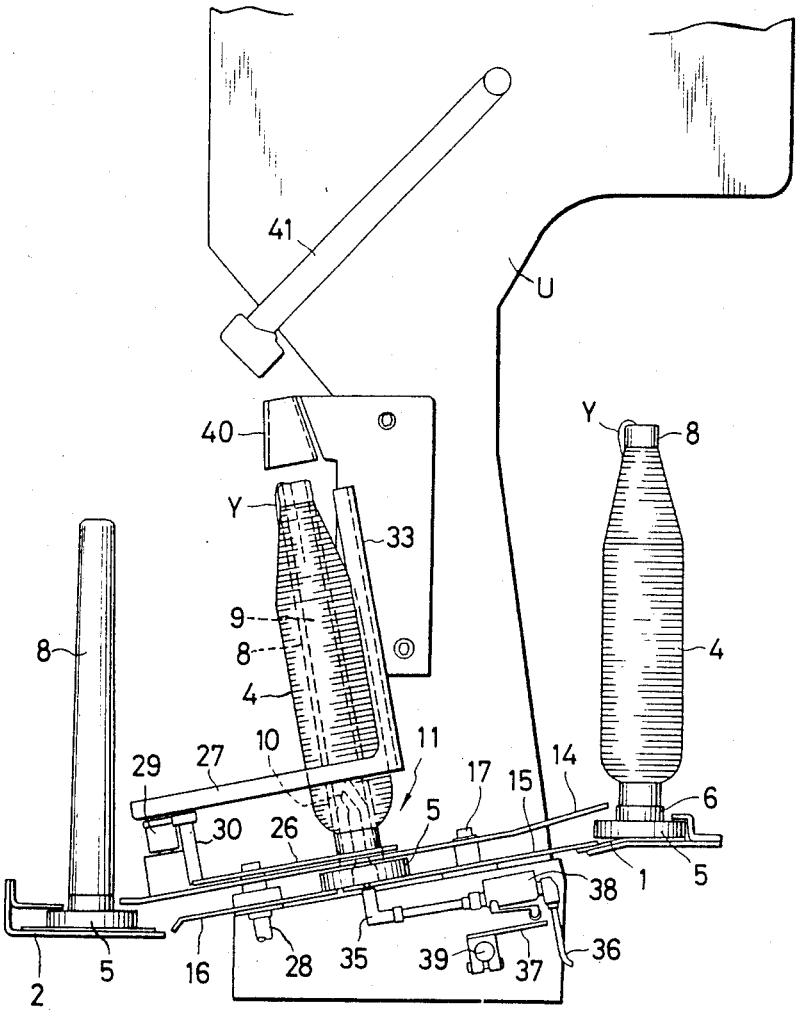
FIG. 1 is a side elevation of a bobbin supplying device according to the present invention.
Figure 2:
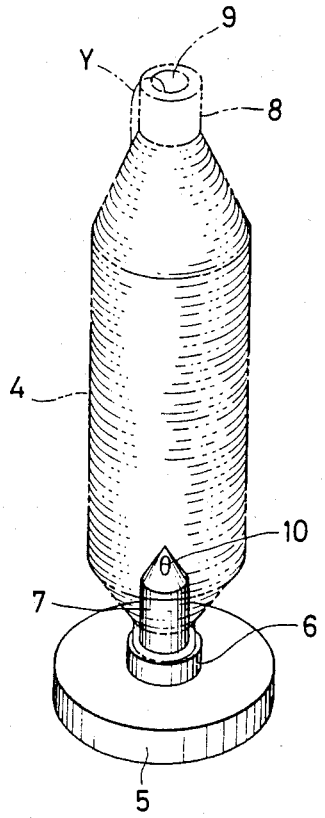
FIG. 2 is a perspective view of a bobbin as mounted on a carrier.

Referring to FIG. 1 showing a bobbin supplying device according to the present invention in a side elevation, a plurality of winding units U are arranged in an array, a bobbin feeding conveyor 1 and an empty bobbin ejecting conveyor 2 are extended below the winding units U so as to run along the row of the winding unit. A full bobbin supplying and empty bobbin ejecting unit is disposed between the conveyors 1 and 2. The bobbin feeding conveyor 1 conveys a full bobbin 4 mounted on a hollow disk-shaped bobbin carrier 5 as shown in FIG. 2. A peg 7 is fixed to the central disk 6 of the bobbin carrier 5. The bobbin tube 8 of the bobbin 4 is fitted on the peg 7 with the bottom end thereof in contact with the central disk 6 so that the bobbin 4 is erected on the carrier 5. A cavity formed in the bobbin carrier 5 communicates with the central bore 9 of the bobbin tube 8 by means of a through hole 10 formed in the free end of the peg 7. The yarn end Y of the bobbin 4 is pulled out from the yarn layers and is suspended in the central bore 9 of the bobbin tube 8 from the top end of the bobbin tube 8. The bobbin feeding conveyor 1 and the bobbin ejecting conveyor 2 are extended on different levels respectively. A bobbin supplying and empty bobbin ejecting unit is disposed so as to interconnect diagonally the bobbin feeding conveyor 1 and the bobbin ejecting conveyor 2. The full bobbin 4 is carried from the bobbin feeding conveyor 1 to the yarn running position in the bobbin supplying and empty bobbin ejecting unit, where the yarn on the bobbin 4 is wound up on a yarn package, not shown, by the winding unit U. The empty bobbin 8 is discharged from the winding position and is delivered by the empty bobbin ejecting conveyor 2.

Figure 3:
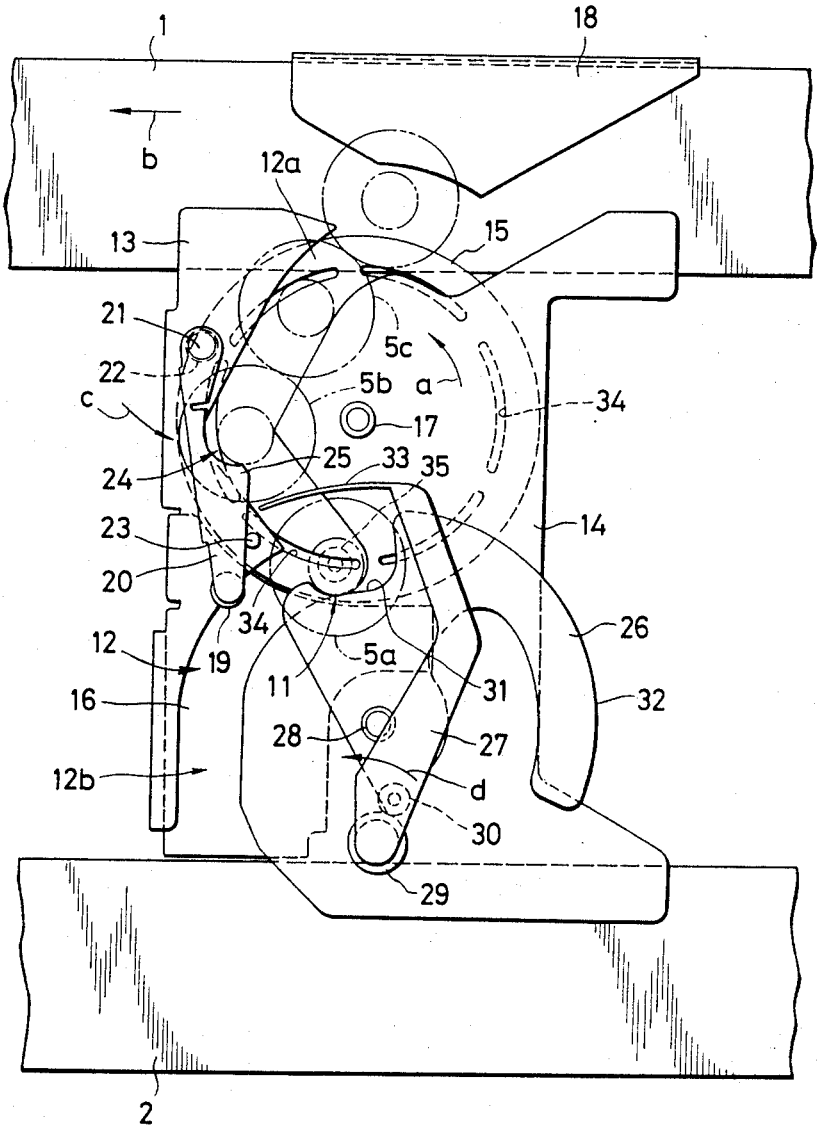
FIGS. 3 and 4 are plan views of a bobbin supplying and bobbin ejecting unit.
Figure 4:
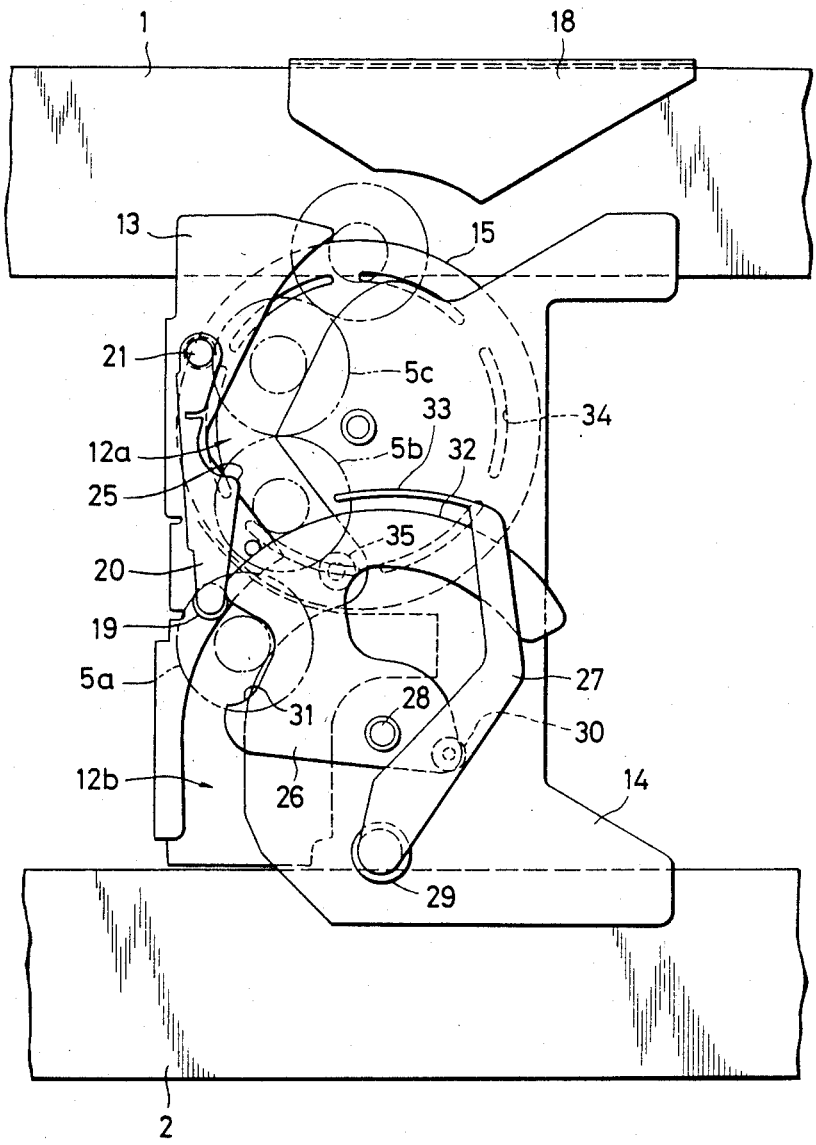

Referring to FIGS. 3 and 4 showing the details of the bobbin supplying and empty bobbin ejecting unit, first and second quide plates 13 and 14 for forming a curved path 12 are fixed to a frame. A free rotary disk 15 forms the bottom surface of the reserve line 12*a* of the path 12, while a bottom plate 16, formed by bending part of the first guide plate 13, forms the bottom surface of the eject line 12*b* of the path 12. The bobbin feeding conveyor 1, the rotary disk 15, the bottom plate 16 and the bobbin ejecting conveyor 2 are arranged to form a substantially continuous flush surface. Part of the bobbin feeding conveyor 1 is in contact with part of the rotary disk 15 to apply a rotative force to the rotary disk 15, so that the rotary disk 15 is rotated on a shaft 17 in the direction of the arrow a. The bobbin feeding conveyor 1 is provided further with third guide plates 18. Each third guide plate 18 guides some of the carriers 5 being conveyed in the direction of the arrow b by the bobbin feeding conveyor 1 into the reserve line 12*a* of the path 12 and let the other surplus carriers 5 pass by the winding unit.

A first stopper 20 provided at the free end thereof with a free roller 19 is pivotally mounted on the first guide plate 13 by means of a shaft 21. A spring 22 is biasing the first stopper 20 in the direction of the arrow c. The swing motion of the first stopper 20 in the direction of the arrow c is limited by a pin 23 keeping the first stopper 20 in place.

The first stopper 20 has a protruding part 25 which narrows the width of the exit of the first bend of the path 12, namely, the exit of a stand-by position 24, to a size smaller than the outside diameter of the disk 6 of the carrier 5. The first stopper 20 thus stops the carrier 5 transferred from the bobbin feeding conveyor 1 onto the reserve line 12*a* of the path 12 at the stand-by position 24 and retains two carriers 5 always within the reserve line 12*a*. A second stopper 26 and a balloon guide 27 are pivotally mounted on the second guide plate 14 by means of shafts 28 and 29 respectively. The second stopper 26 and the balloon guide 27 are in mechanical communication with each other by means of a shaft 30. The second stopper 26 has a recess 31 which holds the carrier 5 at the disk 6 thereof at a second bend of the path 12, namely, the above-mentioned yarn running position 11. The second stopper 26 further has a roller supporting edge 32 curved in an arc of a circle with its center at the shaft 28. The balloon guide 27 provided at the free end thereof a flat curved plate 33 is urged rotatively in the direction of the arrow d by a spring, not shown. The inner edge of the balloon guide 27 is always in abutment with the shaft 30 supported on the second stopper 26, and thereby the rotative tendency of the balloon guide 27 is restrained by the shaft 30. The first stopper 20 is located so that the second carrier 5*b* is arrested by the protrusion 25 of the first stopper 20 at a proper space from the carrier 5*a* located at the yarn running position, and thereby the curved plate 33 of the balloon guide 27 is allowed to enter between the carriers 5*a* and 5*b* without touching the respective surfaces of the full bobbins carried on the carriers 5*a* and 5*b* regardless of the outside diameter of the bobbin.

A plurality of arcuate slots 34 are formed in the rotary disk 15 along a circle with its center at the shaft 17. When the carrier 5 is located at the yarn running position 11, the center axis of the peg 7 thereof coincides with one of the slots 34. A nozzle 35 for jetting compressed air toward the slot 34 is disposed below the slot 34 on the extension of the center axis of the peg 7 of the carrier 5 as located at the yarn running position 11. The nozzle 35 is connected through a valve 38 adapted to be controlled with a lever 37 to an air hose 36 for supplying compressed air to the nozzle. The air supplied through the hose 36 is allowed to flow through the valve 38 by the swing motion of the lever 37 resulting from the rotary motion of a shaft 39 and is jetted out through the nozzle 35. Then, the air jetted out through the nozzle 35 flows through the slot 34 into the cavity of the carrier 5 and further through the through hole 10 of the peg 7 into the central bore 9 of the bobbin tube 8 to blow up the yarn end Y suspended in the central bore 9. The yarn end Y is blown upward through a yarn guide 40 fixed to the winding unit U and is sucked into and held by a suction pipe 41 disposed above the yarn guide 40, where the yarn end Y and the yarn end taken out from the yarn package, not shown, are knotted to wind up the yarn of the bobbin on the yarn package.

The manner of operation of the bobbin supplying and empty bobbin ejecting unit will be described hereinafter in connection with FIGS. 3 and 4. Referring first to FIG. 3 showing the condition of the cop bobbin supplying and empty bobbin ejecting unit in the normal yarn winding operation, one carrier 5*a* and two carriers 5*b* and 5*c* are located at the yarn running position 11 and in the reserve line 12*a* respectively. The first carrier 5*a* located at the yarn running position 11 is held at the disk 6 thereof within the recess 31 of the second stopper 26, the second carrier 5*b* located at the stand-by position 24 is in abutment, at the disk 6 thereof, with the protrusion 25 of the first stopper 20, so that the second carrier 5*b* is restrained from being fed by the disk 15. The curved plate 33 of the balloon guide 27 is interposed between the first carrier 5*a* and the second carrier 5*b* so that the balloon formed by the unwinding motion of the yarn of the bobbin 4 mounted on the first carrier 5*a* will not influence the bobbin 4 mounted on the second carrier 5*b*.

The completion of the unwinding of the bobbin 4 mounted on the first carrier 5*a* is detected by the winding unit U, and then a solenoid, not shown, is actuated to rotate the shaft 28 through a fixed angle. Consequently, the second stopper 26 is rotated counterclockwise as shown in FIG. 4 with the first carrier 5*a* held within the recess 31 to move the first carrier 5*a* through the eject line 12*b* onto the bobbin ejecting conveyor 2. As the second stopper 26 is rotated, the shaft 30 of the second stopper 26 moves pushing the inner surface of the balloon guide 27, so that the balloon guide 27 is turned clockwise. Furthermore, the roller supporting edge 32 of the second stopper 26 is brought into contact with the free roller 19 of the first stopper 20 to cause the protrusion 25 of the first stopper 20 to retract leftward. Accordingly, the second carrier 5*b* is released from the protrusion 25 and is fed by a transfer mechanism which includes disk 15 until it is stopped by the roller supporting edge 32 of the second stopper 26.

Then, the solenoid is unenergized to allow the second stopper 26 to return to its original position. Consequently, the balloon guide 27 and the first stopper 20 are allowed to return to the respective original positions as shown in FIG. 3, and hence the second carrier 5*b* which has been stopped by the roller supporting edge 32 is fed into the recess 31 of the second stopper 26, namely, to the yarn running position 11. At the same time, the shaft 39 shown in FIG. 1 is turned by a driving unit, not shown, to open the valve 38 to jet compressed air from the nozzle 35 through the slot 34 of the disk 15 and the through hole 10 of the peg 7 into the central bore of the bobbin mounted on the second carrier 5*b*. Thus, the yarn end Y of the bobbin 4 is blown upward and is sucked and held by the suction pipe 41 to start winding the yarn of the bobbin 4. While the second carrier 5*b* is moved to the yarn running position, the third carrier 5*c* which has been staying in the reserve line 12*a* is moved to the stand-by position 24 replacing the second carrier 5*b* and is stopped there by the protrusion 25 of the first stopper 20, and one of carriers 5 being conveyed successively by the bobbin feeding conveyor 1 is guided into the reserve line 12*a*.

In the bobbin supplying and empty bobbin ejecting unit, the yarn running position 11 for the carrier 5 is located on the disk 15 being rotated negatively by the bobbin feeding conveyor 1. Therefore, the transfer of the carrier 5 from the stand-by position to the yarn running position is carried out surely and quickly, and hence welltimed air jetting operation and the transfer of the carrier to the yarn running position can be attained so that the yarn end Y is blown upward surely by the air jetted from the nozzle. Furthermore, the linear flow of the air jetted by the nozzle 35 from the nozzle 35 through the slit 34 formed in the disk 15 into the through hole 10 of the peg 7 further ensures the upward blowing of the yarn end Y.

What is claimed is:

1. A device for supplying a plurality of bobbins in sequence to a winder, each one of said bobbins being positioned on a bobbin carrier, said device comprising:

first means for securing a first one of said bobbins and carriers in a standby position, second means for securing a second one of said bobbins and carriers in a yarn running position, transfer means for transferring each one of said bobbins and carriers in sequence from said standby position to said yarn running position, delivery means for delivering a yarn end of said bobbin to said winder when said bobbin and carrier is in said yarn running position, said first means operating to maintain said first bobbin and carrier in spaced relationship with said second bobbin and carrier, whereby interference between the outer surfaces of said first and second bobbins is reduced or eliminated;

wherein said first means comprises:

a stopper, said stopper being pivotable between a first position and a second position, wherein said first bobbin and carrier is prevented from movement from said standby position when said stopper is in said first position and said first bobbin and carrier is released for movement to said yarn running position when said stopper is in said second position.

2. A device as in claim 1 further comprising:

channel means through which said bobbins and carriers are transferred, protrusion means attached to said stopper, said channel means being at least partially obstructed by said protrusion means when said stopper is in said first position, whereby said first bobbin and carrier is prevented from movement from said standby position by said obstruction.

3. A device as in claim 1 wherein:

said delivery means further comprises a fluid jet means, said transfer means is interposed between said fluid jet means and said bobbin and carrier in said yarn running position, and a fluid communication means for communicating fluid from said jet to said bobbin in said yarn running position.

4. A device as in claim 3 wherein said transfer means comprises a rotary disk.

5. A device as in claim 4 wherein said fluid communication means comprises a plurality of perforations in said rotary disk.

6. A device as in claim 5 wherein said perforations comprise an arcuate slot.

7. In a device for sequentially transferring a plurality of bobbins and carriers to a yarn running position of a winder, the improvement comprising:

first means for securing the next-in-sequence bobbin and carrier at a standby position so that said next-in-sequence bobbin and carrier is spaced from the bobbin and carrier at the yarn running position; and second means for securing the bobbin and carrier at said yarn running position, wherein said first means comprises:

a stopper, said stopper being pivotable between a first position and a second position, wherein said next-in-sequence bobbin and carrier is prevented from movement from said standby position when said stopper is in said first position and said next-in-sequence bobbin and carrier is released for movement to said yarn running position when said stopper is in said second position.

8. In a device for sequentially transferring a plurality of bobbins and carriers to a yarn running position of a winder, the improvement comprising:

first means for temporarily securing the next-in-sequence bobbin and carrier at a standby position so that said next-in-sequence bobbin and carrier is spaced from the bobbin and carrier at the yarn running position until said next-in-sequence bobbin and carrier is transferred to the yarn running position; and second means for securing the bobbin and carrier at said yarn running position, wherein said first means further comprises:

a stopper, said stopper being pivotable between a first position and a second position, wherein said next-in-sequence bobbin and carrier is prevented from movement from said standby position when said stopper is in said first position and said next-in-sequence bobbin and carrier is released for movement to said yarn running position when said stopper is in said second position.

9. In a yarn winding unit having a fluid jet for delivering a yarn end carried by one of a plurality of bobbins and carriers which are sequentially positioned at a yarn running position to a winding mechanism, the improvement comprising:

transfer means interposed between said fluid jet and said bobbin and carrier for transferring said bobbin and carrier to said yarn running position, fluid communication means for communicating fluid from said jet to said bobbin and carrier in said yarn running position, first means for securing a first one of said bobbins and carriers in a standby position, second means for securing a second one of said bobbins and carriers in said yarn running position, wherein said first means further comprises:

a stopper, said stopper being pivotable between a first position and a second position, wherein said next-in-sequence bobbin and carrier is prevented from movement from said standby position when said stopper is in said first position and said next-in-sequence bobbin and carrier is released for movement to said yarn running position when said stopper is in said second position.

* * * * *